United States Patent [19]

Hwang

[11] Patent Number: 4,860,561

[45] Date of Patent: Aug. 29, 1989

[54] NUMERICAL LOCK

[76] Inventor: Blake Hwang, No. 40, Sau-an St., Taipei, Taiwan

[21] Appl. No.: 317,431

[22] Filed: Mar. 1, 1989

[51] Int. Cl.[4] ..... E05B 37/08

[52] U.S. Cl. ..... 70/28; 70/23

[58] Field of Search ..... 70/28, 27, 29, 30, 24, 70/25, 26, 23, 22, 21, 20, 32–34

[56] References Cited

U.S. PATENT DOCUMENTS 512,979 1/1894 Lowrie ..... 70/23

1,018,756 2/1912 Gordon ..... 70/23

1,712,476 5/1929 Coiro ..... 70/28

4,803,856 2/1989 Ling ..... 70/28

*Primary Examiner*—Robert L. Wolfe

*Attorney, Agent, or Firm*—Bernard R. Gans

[57] ABSTRACT

A numerical lock includes a housing having a hooking member, a cover, a plurality of numerical wheels, a plurality of sleeves, a control rod having a head, a numerical-changing piece having a pushing member, and a pivotally mounted locking piece capable of engaging with the head to slide the control rod in the lock.

1 Claim, 2 Drawing Sheets

NUMERICAL LOCK

BACKGROUND OF THE INVENTION

The present invention relates to a lock, and more particularly to a numerical lock.

In the prior art, there are various kinds of locks been designed. One of them is a numerical lock which can be used without a key for convenience. The most known numerical locks are unable to be changed their combinations and are obviously undependable because of unique opened number which may be found out undesiredly. There still are other numerical locks which have changable combinations but rise structure complexity and cost.

SUMMARY OF THE INVENTION

It is therefore an object of the present invention to provide a numerical lock capable of being conveniently operated.

It is further an object of the present invention to provide a numerical lock having a numerical-changing function.

According to the present invention, a numerical lock includes a housing having a hooking member, a cover, numerical wheels, sleeves, a control rod having a head, a numerical-changing piece having a pushing member capable of being actuated from the outer side of the lock, and a locking piece having a pivoted first end, a second opposite end, and an intermedicate projection capable of engaging with the head.

The present invention may best be understood through the following description with reference to the accompanying drawings, in which:

DETAILED DESCRIPTION OF THE PREFERRED EMBODIMENT

Figure 1:
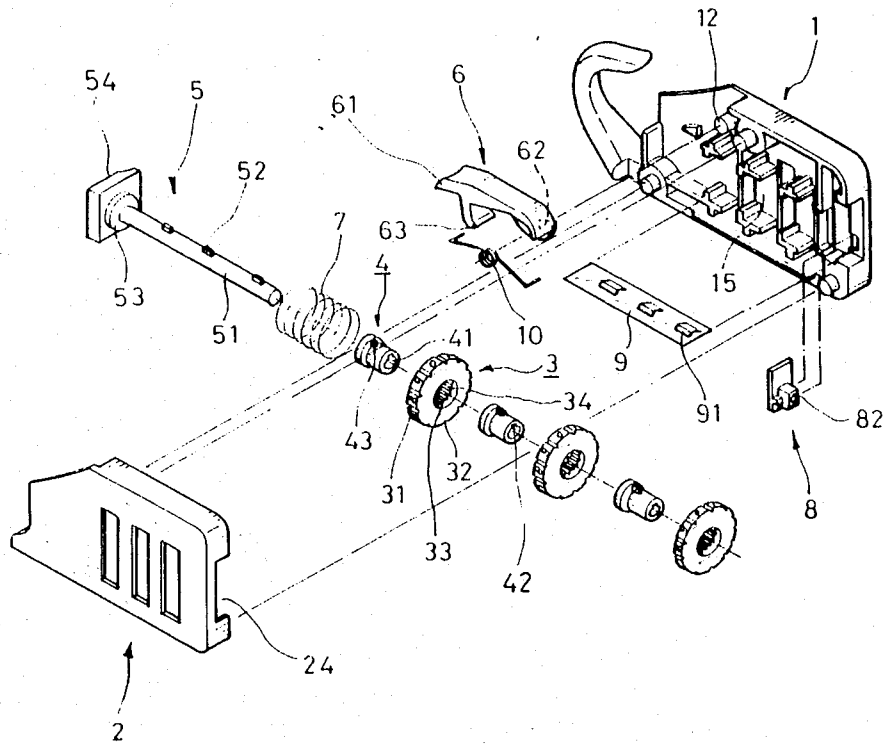
FIG. 1 is an exploded view showing a first preferred embodiment of a numerical lock according to the present invention.
Figures 2, 3, 4:
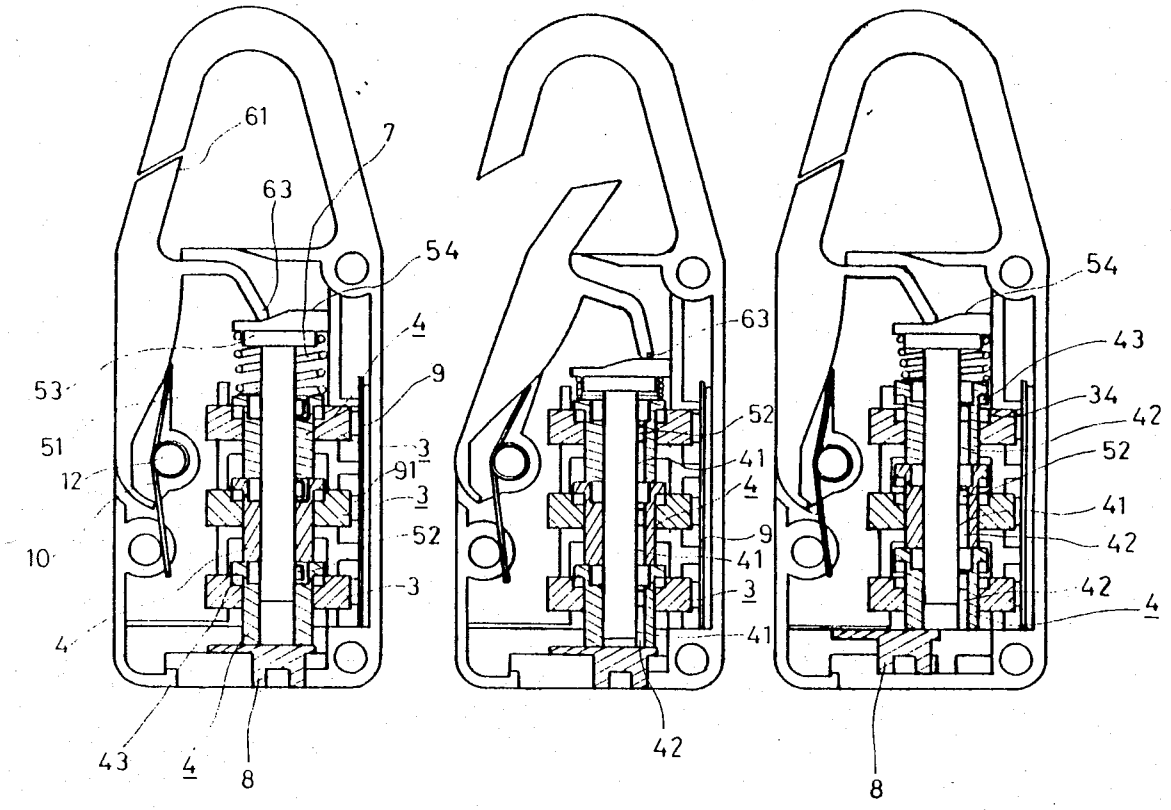
FIG. 2 is a sectional view showing a numerical lock in FIG. 1 in a locked state.
FIG. 3 is a sectional view showing a numerical lock in FIG. 1 in an opened state.
FIG. 4 is a sectional view showing a numerical lock in FIG. 1 in a numeral-changing state.

Referring now to FIGS. 1–4, a numerical lock according to the present invention includes a housing 1, a cover 2, numerical wheels 3, sleeves 4, a control rod 5, a locking piece 6, a spring 7, a numerical-changing piece 8 and an urging plate 9. Each numerical wheel 3 protrudes from housing 1 and cover 2 and includes numerals 31, notches 32, a central hole 33 and inner teeth 34 having a number equal to that of numerals 31.

Each sleeve 4 includes a central hole 41, an inner keyway 42 and an outer tooth 43 engagable with one of teeth 34. Control rod 5 includes a head 54, a journal 53 and a shank portion 51 having a plurality of axial projections 52 each of which is capable of engaging and disengaging with inner keyway 42. Locking piece 6 includes an end hole 62 rotatably receiveing therein a projection 12 on housing 1, an opposite end 61 capable of cooperating with a hooking member 11 of housing 1 to form a locking hook, and an intermediate projection 63 capable of engagng with head 54 to slide control rod 5 axially. Spring 7 is mounted between journal 53 and the first sleeve 4. Urging plate 9 has tongues 91 each of which is urgingly engaging with a notch 32 of wheel 3 so that the user can easily ascertain how many numerals 31 he has rotated wheel 3 to pass through. A spring 10 assists spring 7 to return locking piece 6 to the locked position.

When numerical wheels 3 together with sleeves 4 freely rotatable in rooms 15 in housing 1 are properly rotated with keyways 42 respectively aligned with axial projections 52, locking piece 6 can be downward pivoted to forcedly engage intermediate projection 63 with head 54 to slide axial projections 52 into keyways 42 to obtain an unlocking state for the present lock. If there is any axial projection 52 not aligning with the respective keyway 42, control rod 5 cannot be slid and thus present lock is kept locked.

Numeral-changing piece 8 includes a pushing member 82 capable of being actuated from the outer side of the present lock. Upon changing the numerals for the present lock, pushing member 82 is upward pushed and then laterally translated to a provisional position after the wheels 3 of the present lock are suitably rotated to have correct numerals. Since pushing member 82 upward pushes sleeves 4 to disengage teeth 43 and 34 and to engage axial projections 52 in keyways 42, numerical wheels 3 can be independently rotated to perform the numeral-changing function. After a new set of correct numerals is obtained, pushing member 82 is laterally translated in the opposite direction to allow spring 7 to engage together teeth 43 and 34 and to return pushing member 82 to the original position to complete the numeral-changing procedure. It should be readily apparent that the numeral-changing function can only be performed if wheels 3 are rotated to have correct numerals which allows pushing member 82 to be upward pushed.

What I claim is:

1. A numerical lock comprising a housing and a cover cooperating with each other to suitably interconnect therein as in the prior art a plurality of numerical wheels, a plurality of sleeves, a control rod, a spring and a numeral-changing piece, wherein the improvement resides in that: said housing includes a hooking member; each of said sleeves includes an inner keyway; said control rod includes a head and a plurality of axial projections each of which is capable of engaging and disengaging with said inner keyway; said lock further includes a locking piece having a first end pivotally mounted in said cooperated housing and cover, a second opposite end capable of cooperating with said hooking member and said housing to form a locking hook, and an intermediate projection capable of engaging with said head to slide said control rod in said lock.

* * * * *